United States Patent [19]

Iiyama et al.

[11] 4,096,837

[45] Jun. 27, 1978

[54] AUTOMATIC CHOKING DEVICE OF ELECTRIC HEATING TYPE

[75] Inventors: Masahiko Iiyama, Tokyo; Makoto Ishii, Wako, both of Japan

[73] Assignee: Honda Giken Kogyo Kabushiki Kaisha, Japan

[21] Appl. No.: 748,634

[22] Filed: Dec. 8, 1976

[30] Foreign Application Priority Data

Dec. 16, 1975 Japan ..... 50/149949

[51] Int. Cl.[2] ..... F02D 11/08; F02M 1/110; F02M 23/04

[52] U.S. Cl. ..... 123/119 F; 261/39 E; 219/207; 236/101 C

[58] Field of Search ..... 219/206, 207, 201; 123/119 F; 261/39 E, 23 A; 236/101 C

[56] References Cited

U.S. PATENT DOCUMENTS

| | | | |
|---|---|---|---|
| 3,752,133 | 8/1973 | Irish et al. | 123/119 F |
| 3,763,837 | 10/1973 | Orlando | 123/119 F |
| 3,806,854 | 4/1974 | Armstrong | 123/119 F X |
| 3,818,881 | 6/1974 | Hosho | 123/119 F |
| 3,898,422 | 8/1975 | Fuller | 219/201 |
| 3,972,311 | 8/1976 | De Petris | 123/119 F |
| 4,038,955 | 8/1977 | Paulmier | 123/119 F |
| 4,054,620 | 10/1977 | Daigler | 123/119 F |
| 4,058,097 | 11/1977 | Silverstein | 123/119 F |

*Primary Examiner*—Wendell E. Burns
*Attorney, Agent, or Firm*—Polster, Polster and Lucchesi

[57] ABSTRACT

An automatic choking device of an electric heating type for use in an automobile engine and the like having a carburetor main body, a choke valve provided in the carburetor main body, a shaft for rotating the choke valve which is supported on the carburetor main body in a freely rotable manner, a bimetal member connected to the rotational shaft for the choke valve by means of a connecting member, and to cause the rotational shaft to rotate, when heated, to open the choke valve, heating means having an electric heating mechanism to heat the bimetal member, and a switch means to open and close a connecting circuit between the heating means and a power source for the same, in which the electric heating mechanism functions to maintain the choke valve in a substantially perfectly closed state without actuating the bimetal member when the internal combustion engine is at a low temperature level, to open the choke valve by heating the bimetal as the temperature of the engine rises with lapse of time, and to lower the temperature thereof after the bimetal is sufficiently heated to be able to open the choke valve.

34 Claims, 5 Drawing Figures

AUTOMATIC CHOKING DEVICE OF ELECTRIC HEATING TYPE

BACKGROUND OF THE INVENTION

This invention is concerned with an automatic choking device of an electric heating type for use in automotive vehicles.

The automatic choking device of an electric heating type should preferably have such functions that it prevents the choke valve from opening in an earlier or premature stage of an engine operation than required, and, after opening of the valve, controls the amount of electric current conduction to avoid burning of the heater, thereby saving the electric power consumption.

In order to attain such desirable functions in the automatic choking device of the electric heating type, it may become necessary to construct the same in the following manner.

(a) When the engine is at a temperature level ranging from an extreme low temperature to a low temperature, the amount of electric current conduction to a heater for heating a bimetal is limited so as to suppress abrupt heat generation from the heater, thereby maintaining the valve in its required full close state or in its low degree of opening depending on the circumstances.

(b) When the engine is at a high temperature, the amount of electric current conduction to the heater is limited as small as possible, after the valve is in its full open state.

For the automatic choking device which attains the abovementioned purpose (a), there have so far been known such ones that an NTC element (Negative Temperature Coefficient), that is, a negative characteristic heat sensitive resistance element which shows a high resistance value in a low temperature region, and which indicates a lowering resistance value as the temperature rises, is incorporated in a heater circuit so as to limit the amount of electric current conduction to the heater, when the engine is maintained at a temperature level ranging from an extremely low temperature to a low temperature.

On the other hand, for the automatic choking device which attains the abovementioned purpose (b), there have been known such ones that a PTC element (Positive Temperature Coefficient), that is, a positive characteristic heat sensitive element which shows a low resistance value at a low temperature region, and which indicates a rising resistance value as the temperature rises, is incorporated in the heater circuit so as to restrict the amount of electric current conduction to the heater after the valve becomes fully opened, or the abovementioned NTC element and PTC element are combined to control the amount of electric current conduction in the heater.

However, in the above-described emboidments of the automatic choking device, those which utilize either the NTC element or the PTC element alone can satisfy any one of the purposes (a) and (b) as mentioned above, while the choking device utilizing both elements in combination becomes expensive in its manufacturing cost, and, moreover, the construction thereof such as wiring, etc. becomes complicated, or any other problems.

SUMMARY OF THE INVENTION

In view of the foregoing problems inherent in the conventional automatic choking device of an electric heating type, it is a primary object of the present invention to provide an improved automatic choking device of an electric heating type, in which a novel heat sensitive resistance element having both functions of NTC and PTC (hereinafter called "N-PTC element") is utilized as one of the elements of a bimetallic electric heating means, thereby preventing the choke valve from opening at an earlier stage of an engine operation than required, and controlling the amount of electric current conduction to the electric heating means after the choking valve becomes fully opened, thus saving the electric power consumption.

It is the secondary object of the present invention to provide an improved automatic choking device of the electric heating type having a simple and highly precise construction.

According to the present invention, briefly speaking, there is provided an automatic choking device of an electric heating type which is constructed with a carburetor main body, a choke valve provided in the carburetor main body, a choke valve rotating shaft supported in the carburetor main body in a freely rotatable manner, a bimetallic member connected with the choke valve rotating shaft by way of a connecting member and which opens the choke valve by rotation of the choke valve rotating shaft, an electric heating mechanism having functions to maintain the choke valve in a substantially closed state without actuating the bimetallic member, while an engine is at a low temperature, and to open the choke valve by heating the bimetallic member when the engine is raised to a high temperature as time goes by, heating means having a function to reduce the temperature, and a switch to open and close a connecting circuit between a power source for the heating means and the heating means.

There has thus been outlined rather broadly, the more important features of the invention in order that the detailed description thereof that follows may be better understood, and in order that the present contribution to the art may be better appreciated. There are, of course, additional features of the invention that will be described hereinafter and which will form the subject of the claims appended hereto. Those skilled in the art will appreciate that the conception, upon which this disclosure is based, may be readily utilized as a basis for the designing of other structure for carrying out the several purposes of the invention. It is important therefore that the claims be regarded as including such equivalent constructions as do not depart from the spirit and scope of the invention.

BRIEF DESCRIPTION OF THE ACCOMPANYING DRAWING

Specific embodiments of the invention have been chosen for the purposes of the illustration and description, and are shown in the accompanying drawings, forming a part of the specification, in which.

DETAILED DESCRIPTION OF PREFERRED EMBODIMENTS

In the following, the present invention will be explained in detail in reference to the preferred embodiments shown in the accompanying drawing.

Figure 1:
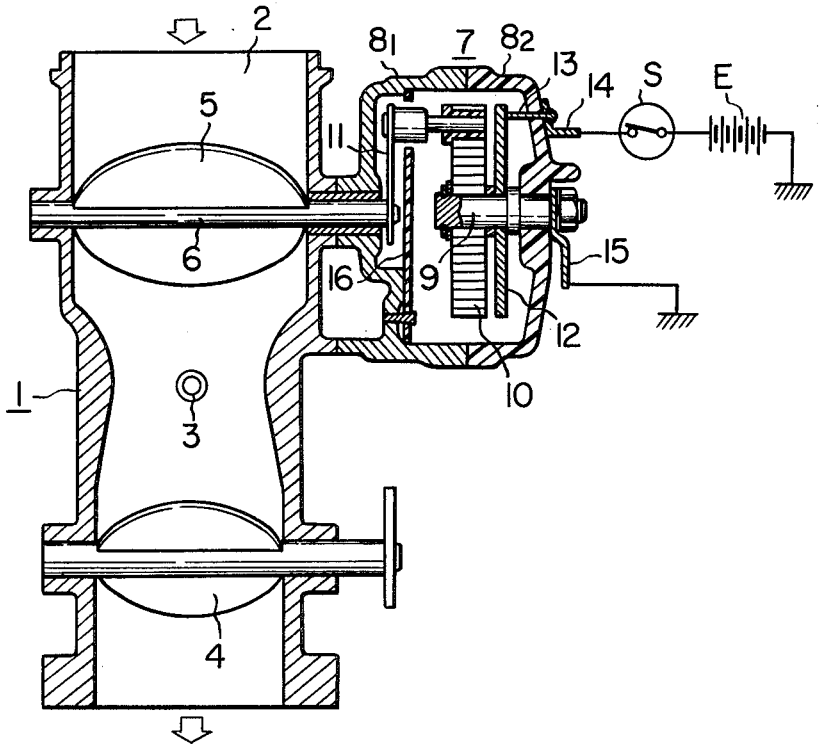
FIG. 1 is a longitudinal cross-section of one embodiment of the automatic choking device of an electric heating type according to the present invention.

Referring first to FIG. 1, a reference numeral 1 designates a carburetor main body, in an air-intake passage 2 of which there are accommodated a main nozzle 3, a throttle valve 4, and a choke valve 5. A rotational shaft 6 of the choke valve 5 is supported on a wall portion of the main body in a freely rotatable manner, one end of which projects into a housing 7 accommodating therein a bimetal 10. The housing 7 comprises an electrically conductive main body $8_1$ and an electrically insulative cover $8_2$, the electrically conductive main body $8_1$ being fixed to the carburetor main body 1. To the electrically insulative cover $8_2$ constituting the housing 7, there is fixed an electrically conductive fixed shaft 9 which is positioned on a substantially same axial line as that of the rotational shaft 6 of the abovementioned choke valve 5. The inner end part of a spiral bimetal 10 is fixed onto the abovementioned electrically conductive fixed shaft 9, the outer end part of which is connected to one end of the rotational shaft 6 of the abovementioned choke valve 5 through an arm 11 in the form of a letter "L". Opposite to the bimetal 10, heating means 12 such as, for example, a disc-shaped heater as shown in the drawing is fixed to the electrically insulative fixed shaft 9 in a state of its being electrically connected thereto. The heater 12 is further connected to a circuit consisting of an engine starting switch S and a power source E through a lead line 13 and a terminal 14, while the abovementioned fixed shaft 9 is grounded through a terminal 15. A reference numeral 16 designates a heat insulative plate fixed to the main body $8_1$ of the housing 7 in confrontation to the bimetal 10.

Figure 2:
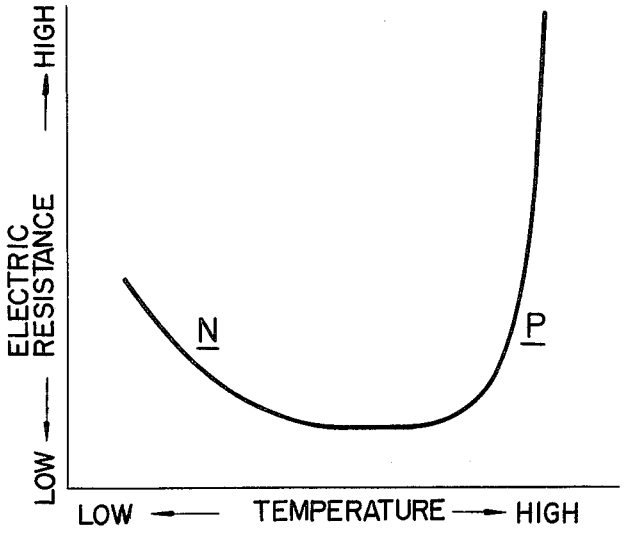
FIG. 2 is a graphical representation showing a characteristic curve of temperature versus resistance value in N-PTC element used in the automatic choking device according to the present invention.

The abovementioned disc-shaped heater 12 consists of the N-PTC element as described in the foregoing. This N-PTC element has a negative characteristic region (N) and a positive characteristic region (P) as shown in the curve of FIG. 2, on account of which it exhibits a unique temperature versus resistance value variations. That is, in a low temperature region (*l*) of a temperature (T), the element exhibits a high resistance value, and, with increase in the temperature, it gradually reduces its resistance value. On the other hand, it again exhibits a high resistance value at a high temperature region (h).

The material for the abovementioned N-PTC element consists of silver (Ag), barium (Ba), lead (Pb), and aluminum (Al) as the principal constituent. Besides these principal constituent material, there may be further contained, in a small quantity, copper (Cu), titanium (Ti), strontium (Sr), and niobium (Nb). These materials are used in the form of a single body or in the form of a compound, which are shaped into a disc and sintered for use as the heater element.

In the low temperature condition of the engine prior to its start, a force is imparted to the rotational shaft 6 of the choke valve 5 in the closing direction of the valve through the L-shaped arm 11 owing to the expanding characteristic of the spiral bimetal 10 at a low temperature, whereby the choke valve 5 is in a completely closed state.

When the engine starting switch S is turned "on" to start the engine, electric current flows in the circuit consisting of the power source E — the switch S — the terminal 14 — the lead wire 13 — the heater 12 — the fixed shaft 9 — the terminal 15 — back to the power source E, whereby the heater 12 is subjected to electric current conduction. The amount of the electric current conduction at this time is small at the outset owing to the low temperature/high resistance characteristic of the N-PTC element (vide: the negative characteristic shown in FIG. 2), on account of which the amount of the heat generation in the heater 12 is small, hence the bimetal 10 is not almost affected by heat and the valve 5 is maintained in its perfectly closed state. Consequently, a required mixture air of thick concentration is introduced into the cylinder of the engine due to the negative pressure caused by the cranking action therein, whereby the introduced mixture air is completely exploded. By the way, with a view to preventing the over-choking phenomenon after completion of the explosion, there may be provided a choke unloader which causes the choke valve 5 to be slightly opened against the bimetal 10 and a valve spring (not shown) by an air-intake pressure which becomes intensified from the moment of the engine start, although it is omitted from showing in the drawing illustration. When the temperature of the engine goes up, and the resistance value of the heater 12 gradually lowers due to heat propagated within the housing 7 through the carburetor main body 1, or due to heat radiation from the engine, or due to heat generation of the heater 12 per se, though in a small quantity, owing to electric current conduction after the engine starting switch S is turned "on", the quantity of electric current flowing through the heater 12 gradually increases. With this increase in the amount of electric current conduction, the quantity of heat generation from the heater 12 increases. The bimetal 10 is heated by the heater 12 in the main, and also by heat transmitted secondarily from the engine through the carburetor main body 1, or by heat radiation therefrom, whereby it is displaced by its own winding characteristics. The quantity of the displacement is transmitted to the rotational shaft 6 of the choke valve 5 through the L-shaped arm 11, whereby the rotational shaft 6 rotates in the direction of the valve opening to gradually open the choke valve 5 in response to the warming-up operation of the engine, and to finally render the valve 5 in its full open state in response to a sufficient temperature rise in the engine.

When the sufficient temperature rise is attained in the engine, heater 12 receives heat transmitted into the housing 7 from the engine through the carburetor main body 1, or through heat radiation, and, at the same time, due to its own heat generation, it exhibits the high temperature/high resistance characteristic (vide: the positive (P) characteristic curve shown in FIG. 2), whereby the amount of current conduction automatically reduces due to its being rendered high resistance. Thereafter, even when the quantity of heat generation from the heater 12 becomes small due to decrease in the amount of electric current conduction to the heater 12, or even if the heater no longer generates heat, the wound state of the bimetal 10 does not change owing to the heat transfer from the engine, and the valve 5 is maintained in its full open state. At the same time, since the heater 12 is also maintained at a state of high resistance owing to the heat transfer from the engine, there occurs no inconvenience such that the resistance decreases again to cause the bimetal to be unnecessarily heated.

As stated in the foregoing, when the N-PTC element is utilized as the heater, the electric current conduction to the heater is restricted due to the negative characteristic thereof when the engine is at a temperature level ranging from an extremely low temperature to a low temperature with the consequence that the so-called premature opening of the valve, wherein the choke valve 5 opens at an early stage, while the engine is still cold, can be prevented without failure. Then, after the engine is satisfactorily warmed, unnecessary electric current conduction is automatically restricted by the positive characteristic of the N-PTC element as the heater with the result that waste in power consumption can be minimized and deterioration of the bimetal due to overheating can be prevented, whereby service life of the device as a whole can be prolonged. Moreover, the construction of the device including the wiring, etc. is very simple, and such simple construction would definitely contributes to provide the automatic choking device of an electric heating type of a low manufacturing cost.

Figure 3:
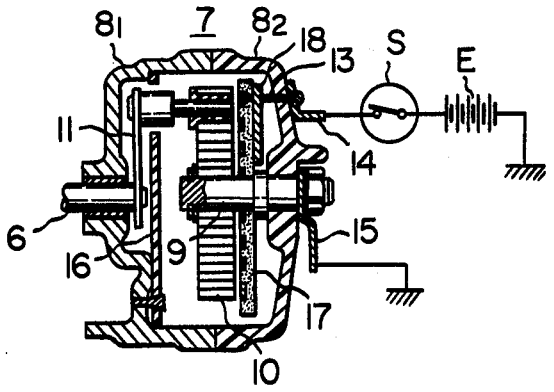
FIG. 3 is a longitudinal cross-section of a second embodiment of the automatic choking device according to the present invention.

FIG. 3 illustrates the second embodiment of the automatic choking device according to the present invention, in which the bimetallic heating means is constructed with a heater comprising an electric resistance type power source 17 (in the case of the illustrated embodiment, this is represented by a heater element), and a ceramic plate; and an N-PTC element 18 which is electrically connected to the heater, and contacts with the same. The element 18 is connected to the switch S through the lead wire 13 and the terminal 14, while the abovementioned heater element is connected to the electrically conductive rotational shaft 9. The amount of electric current conduction to the heater 17 is controlled by this N-PTC element 18, although the function per se is not different from that shown in FIG. 1. In this case, heating of the bimetal 10 is carried out by the heater 17, and the N-PTC element 18 merely performs control of the current conduction to the heater 17. Therefore, in the selection of the element 18, unlike the case shown in FIG. 1, there is no necessity for taking into consideration the heat generating characteristic of the element with the consequence that the range of the selection is widened, hence freedom in designing the device increases. For the element 18 to be used, those having as small a heat generating amount as possible may be selected in particular, whereby the power consumption in the element 18 can be saved. In addition, there occurs no thermal effect to the bimetal 10 due to the heat generation from the element 18, so that the automatic choking device of the electric heating type to be obtained by the present invention is very stable in its characteristics.

Figure 4:
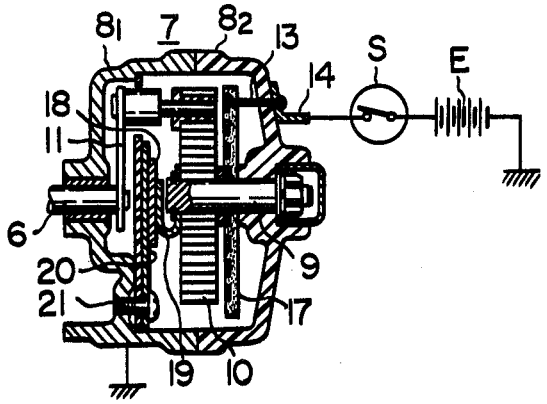
FIG. 4 is a longitudinal cross-section of a third embodiment of the automatic choking device according to the present invention.

FIG. 4 shows a modified embodiment to that shown in FIG. 3. In this modified embodiment, the heater 17 and the N-PTC element 18 are separately disposed at both sides of the bimetal 10. The heater 17 is electrically connected to the switch S through the lead wire 13 and the terminal 14, while the element 18 is connected, at one surface thereof, to the electrically conductive rotational shaft 9 through a contact piece 18, and, at the other surface thereof, to an electrically conductive plate 20 integral with the insulative plate 16. The electrically conductive main body $8_1$ of the housing 7 is earthed.

As explained above, when the N-PTC element 18 and the heater 17 are disposed at separated positions each other, the element 18 does not receive direct influence of heat from the heater 17 with the result that it can sense the ambient temperature of the bimetal 10 and can thereby control the amount of electric current conduction to the heater 17. Thus, the prescision in sensitivity of the choking device is advantageously improved. In this case, the electric current flows in the circuitry composed of the power source E, the switch S, the terminal 14, the lead wire 13, the heater 17, the shaft 9, the contact piece 19, the N-PTC element 18, the electrically conductive plate 20, a threaded screw 21, the housing main body $8_1$, and back to the power source E, in the order as mentioned.

Figure 5:
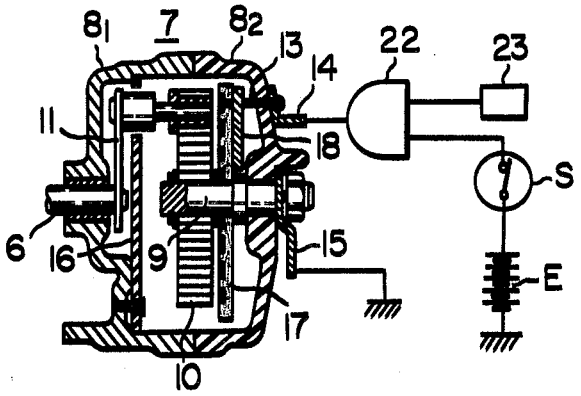
FIG. 5 is a longitudinal cross-section of a fourth embodiment of the automatic choking device according to the present invention.

FIG. 5 is a further modification of the automatic choking device of the electric heating type, in which a relay 22 (in the case of the illustrated embodiment, this is represented by an "AND" circuit) is interposed between the N-PTC element 18 and the switch S shown in FIG. 2, and the other terminal of the "AND" circuit is connected to a detecting means 23 to detect complete explosion. In this modified embodiment, therefore, even when the engine switch S is turned "on", the electric current conduction to the heater 17 is interrupted during a period until the complete explosion in the internal combustion engine takes place, and such electric current conduction to the heater 17 is first resumed when an output signal produced from the complete explosion detecting means 23 is fed to the "AND" circuit 22 as an input after completion of the engine explosion. By thus constructing the automatic choking device in accordance with the present invention, the choke valve 5 is maintained in its full closed state without failure until complete explosion takes place in the engine, hence the starting performance of the engine is advantageously secured.

What is claimed is:

1. An automatic choking device of an electric heating type for use in an automobile engine, and the like which comprises in combination:

(a) a carburetor main body;

(b) a choke valve provided in said carburetor main body;

(c) a shaft for rotating said choke valve, said rotational shaft being supported on said carburetor main body in a freely rotatable manner;

(d) a bimetal member which is connected to said rotational shaft for the choke valve by means of a connecting member, and which causes said rotational shaft to rotate, when heated, to open said choke valve;

(e) heating means having an electric heating mechanism to heat said bimetal member, said electric heating mechanism having functions to maintain said choke valve in a substantially perfectly closed state without actuating said bimetal member when the internal combustion engine is at a low temperature level, to open said choke valve by heating said bimetal as the temperature of the engine rises with lapse of time, and to lower the temperature thereof after the bimetal is sufficiently heated to be able to open the choke valve; and (f) a switch means to open and close a connecting circuit between said heating means and a power source for the same.

2. The automatic choking device of an electric heating type as set forth in claim 1, in which said switch means is an engine starting switch.

3. The automatic choking device of an electric heating type as set forth in claim 1, in which said heating means of said bimetal heating mechanism is a negative-positive temperature coefficient (N-PTC) element having such properties that indicate a high resistance value at the time of the engine being at a low temperature level, a reduced resistance value with temperature increase in the engine, and thereafter an abruptly high resistance value.

4. The automatic choking device of an electric heating type as set forth in claim 2, in which said heating means of said bimetal heating mechanism is a negative-positive temperature coefficient (N-PTC) element having such properties that indicate a high resistance value at the time of the engine being at a low temperature level, a reduced resistance value with temperature increase in the engine, and thereafter an abruptly high resistance value.

5. The automatic choking device of an electric heating type as set forth in claim 1, in which said heating means of said bimetal heating mechanism consists of an N-PTC element which controls an electric resistance type heat source and an amount of electric current conduction to said heat source.

6. The automatic choking device of an electric heating type as set forth in claim 2, in which said heating means of said bimetal heating mechanism consists of an N-PTC element which controls an electric resistance type heat source and an amount of electric current conduction to said heat source.

7. The automatic choking device of an electric heating type as set forth in claim 5, in which said electric resistance type heat source and said N-PTC element are arranged in a mutually contacted state.

8. The automatic choking device of an electric heating type as set forth in claim 5, in which said electric resistance type heat source and said N-PTC element are sepately disposed on both sides of said bimetal.

9. The automatic choking device of an electric heating type as set forth in claim 1, in which a relay is provided between said heater and said switch, one of the terminals of said relay being connected to said switch, and the other terminal thereof being connected to a detecting means to detect complete explosion in the engine, whereby, when a signal indicating closure of the switch and an output signal from said detecting means are fed to said relay as the input signal, the electric current conduction is effected to said heater.

10. The automatic choking device of an electric heating type as set forth in claim 2, in which a relay is provided between said heater and said switch, one of the terminals of said relay being connected to said switch, and the other terminal thereof being connected to a detecting means to detect complete explosion in the engine, whereby, when a signal indicating closure of the switch and an output signal from said detecting means are fed to said relay as the input signal, the electric current conduction is effected to said heater.

11. The automatic choking device of an electric heating type as set forth in claim 3, in which a relay is provided between said heater and said switch, one of the terminals of said relay being connected to said switch, and the other terminal thereof being connected to a detecting means to detect complete explosion in the engine, whereby, when a signal indicating closure of the switch and an output signal from said detecting means are fed to said relay as the input signal, the electric current conduction is effected to said heater.

12. The automatic choking device of an electric heating type as set forth in claim 4, in which a relay is provided between said heater and said switch, one of the terminals of said relay being connected to said switch, and the other terminal thereof being connected to a detecting means to detect complete explosion in the engine, whereby, when a signal indicating closure of the switch and an output signal from said detecting means are fed to said relay as the input signal, the electric current conduction is effected to said heater.

13. The automatic choking device of an electric heating type as set forth in claim 5, in which a relay is provided between said heater and said switch, one of the terminals of said relay being connected to said switch, and the other terminal thereof being connected to a detecting means to detect complete explosion in the engine, whereby, when a signal indicating closure of the switch and an output signal from said detecting means are fed to said relay as the input signal, the electric current conduction is effected to said heater.

14. The automatic choking device of an electric heating type as set forth in claim 6, in which a relay is provided between said heater and said switch, one of the terminals of said relay being connected to said switch, and the other terminal thereof being connected to a detecting means to detect complete explosion in the engine, whereby, when a signal indicating closure of the switch and an output signal from said detecting means are fed to said relay as the input signal, the electric current conduction is effected to said heater.

15. The automatic choking device of an electric heating type as set forth in claim 7, in which a relay is provided between said heater and said switch, one of the terminals of said relay being connected to said switch, and the other terminal thereof being connected to a detecting means to detect complete explosion in the engine, whereby, when a signal indicating closure of the switch and an output signal from said detecting means are fed to said relay as the input signal, the electric current conduction is effected to said heater.

16. The automatic choking device of an electric heating type as set forth in claim 8, in which a relay is provided between said heater and said switch, one of the terminals of said relay being connected to said switch, and the other terminal thereof being connected to a detecting means to detect complete explosion in the engine, whereby, when a signal indicating closure of the switch and an output signal from said detecting means are fed to said relay as the input signal, the electric current conduction is effected to said heater.

17. The automatic choking device of an electric heating type as set forth in claim 9, in which said relay consists of an "AND" circuit.

18. The automatic choking device of an electric heating type as set forth in claim 1, in which said bimetal is in the form of a spiral.

19. The automatic choking device of an electric heating type as set forth in claim 2, in which said bimetal is in the form of a spiral.

20. The automatic choking device of an electric heating type as set forth in claim 3, in which said bimetal is in the form of a spiral.

21. The automatic choking device of an electric heating type as set forth in claim 4, in which said bimetal is in the form of a spiral.

22. The automatic choking device of an electric heating type as set forth in claim 5, in which said bimetal is in the form of a spiral.

23. The automatic choking device of an electric heating type as set forth in claim 6, in which said bimetal is in the form of a spiral.

24. The automatic choking device of an electric heating type as set forth in claim 7, in which said bimetal is in the form of a spiral.

25. The automatic choking device of an electric heating type as set forth in claim 8, in which said bimetal is in the form of a spiral.

26. The automatic choking device of an electric heating type as set forth in claim 9, in which said bimetal is in the form of a spiral.

27. The automatic choking device of an electric heating type as set forth in claim 10, in which said bimetal is in the form of a spiral.

28. The automatic choking device of an electric heating type as set forth in claim 11, in which said bimetal is in the form of a spiral.

29. The automatic choking device of an electric heating type as set forth in claim 12, in which said bimetal is in the form of a spiral.

30. The automatic choking device of an electric heating type as set forth in claim 13, in which said bimetal is in the form of a spiral.

31. The automatic choking device of an electric heating type as set forth in claim 14, in which said bimetal is in the form of a spiral.

32. The automatic choking device of an electric heating type as set forth in claim 15, in which said bimetal is in the form of a spiral.

33. The automatic choking device of an electric heating type as set forth in claim 16, in which said bimetal is in the form of a spiral.

34. The automatic choking device of an electric heating type as set forth in claim 17, in which said bimetal is in the form of a spiral.

* * * * *